US009443453B2

(12) United States Patent
Fallon

(10) Patent No.: US 9,443,453 B2
(45) Date of Patent: Sep. 13, 2016

(54) ILLUMINATED DISPLAY BOARD HAVING AN ANGLED LIGHT SOURCE

(71) Applicant: Green Light Innovations, Lake Saint Louis, MO (US)

(72) Inventor: Timothy G. Fallon, Lake Saint Louis, MO (US)

(73) Assignee: Green Light Innovations, Lake Saint Louis, MO (US)

( * ) Notice: Subject to any disclaimer, the term of this patent is extended or adjusted under 35 U.S.C. 154(b) by 82 days.

(21) Appl. No.: 13/918,167

(22) Filed: Jun. 14, 2013

(65) Prior Publication Data

US 2014/0369071 A1 Dec. 18, 2014

(51) Int. Cl.

| | |
|---|---|
| ***F21K 99/00*** | (2016.01) |
| ***G09F 13/18*** | (2006.01) |
| *G09F 13/22* | (2006.01) |

(52) U.S. Cl.

CPC ..... *G09F 13/18* (2013.01); *G09F 2013/1836* (2013.01); *G09F 2013/222* (2013.01)

(58) Field of Classification Search

CPC ..... G09F 2013/222; G09F 2013/1881; G09F 13/04; G09F 13/18; G09F 13/22; G09F 13/02; G09F 2013/1836; G02F 1/133608; G02F 1/133603; G02F 1/133606

USPC ..... 362/147, 812, 23.16, 632–634, 612, 362/600–606; 40/546, 563, 564, 541

See application file for complete search history.

(56) References Cited

U.S. PATENT DOCUMENTS

| | | | | |
|---|---|---|---|---|
| 374,641 | A | 12/1887 | Taber | |
| 1,850,319 | A * | 3/1932 | Fensom et al. | 40/546 |
| 4,096,656 | A * | 6/1978 | Diceglie | 40/564 |
| D254,643 | S | 4/1980 | Ashenfarb | |
| 4,714,983 | A | 12/1987 | Lang | |
| D358,037 | S | 5/1995 | Monroe | |
| 5,533,286 | A | 7/1996 | Fallon et al. | |
| D372,797 | S | 8/1996 | Ilaria et al. | |
| 5,579,598 | A | 12/1996 | Fallon et al. | |
| 5,943,801 | A * | 8/1999 | Wilkinson | 40/564 |
| 6,039,457 | A * | 3/2000 | O'Neal | 362/388 |
| D480,221 | S | 10/2003 | Luciano | |
| 6,691,443 | B1 | 2/2004 | Slayden | |
| D524,555 | S | 7/2006 | Mohundro | |
| D527,193 | S | 8/2006 | Park | |

(Continued)

FOREIGN PATENT DOCUMENTS

| | | |
|---|---|---|
| CN | 3346228 | 4/2003 |
| CN | 3440155 | 8/2004 |
| CN | 301756425 | 5/2011 |

OTHER PUBLICATIONS

MES Industries Black Frame: announced Apr. 1, 2002, available at URL:http://www.joann.com/5inx7in-black-frames-3-pack/12181137.html#prefn1=isProject&start=156prefn2=isVideo&prefv2=false&sz=54&prefv1=false.

(Continued)

*Primary Examiner* — Elmito Breval
*Assistant Examiner* — Arman B Fallahkhair
(74) *Attorney, Agent, or Firm* — Stinson Leonard Street LLP

(57) ABSTRACT

An illuminated display board includes a frame, a light-transmissive panel, and a light source. The light source is positioned within the frame, and adjacent the light-transmissive panel. The light source is oriented at an angle of between about 25 degrees and about 50 degrees with respect to the light-transmissive panel.

31 Claims, 6 Drawing Sheets

(56) References Cited

U.S. PATENT DOCUMENTS

| | | | | |
|---|---|---|---|---|
| D542,543 | S | 5/2007 | Bruce | |
| 7,473,022 | B2 * | 1/2009 | Yoo | G02B 6/0021 362/294 |
| D610,354 | S | 2/2010 | Kuo | |
| D610,814 | S | 3/2010 | Chigira | |
| D612,617 | S | 3/2010 | Chen | |
| D636,187 | S | 4/2011 | Kim et al. | |
| D651,812 | S | 1/2012 | Lee et al. | |
| 8,151,500 | B2 | 4/2012 | Lin | |
| 8,375,613 | B2 | 2/2013 | Spiro | |
| 2003/0193005 | A1 * | 10/2003 | Hui | A47G 1/162 248/489 |
| 2006/0018126 | A1 | 1/2006 | Choi et al. | |
| 2009/0086504 | A1 | 4/2009 | Kim | |
| 2009/0100727 | A1 * | 4/2009 | Chen | 40/546 |
| 2009/0199444 | A1 | 8/2009 | Robinson | |
| 2010/0090819 | A1 * | 4/2010 | Benedict et al. | 340/447 |
| 2010/0165446 | A1 * | 7/2010 | Danner et al. | 359/296 |
| 2010/0165643 | A1 * | 7/2010 | Russo | F21V 21/04 362/365 |
| 2012/0014134 | A1 * | 1/2012 | Fang et al. | 362/612 |
| 2013/0163238 | A1 * | 6/2013 | Wang et al. | 362/225 |
| 2013/0336005 | A1 * | 12/2013 | Chen | G02B 6/0011 362/611 |
| 2014/0007474 | A1 * | 1/2014 | Varveris | 40/544 |
| 2014/0226361 | A1 * | 8/2014 | Vasylyev | 362/606 |

OTHER PUBLICATIONS

Melody Black Frames: announced Apr. 1, 2002, available at URL:http ://www.joann.com/14x1 8-melody-collage-black/ 13386057. htm l#q=Melody+Black&start=4.

Weathered Oak Stepped Gallery Frame: announced Mar. 8, 2012, available at URL: http://www. res to ration hardware. com/catalog/p roduct/p roduct.jsp ?p roductl d=p rod 1 8605 7 O&catego ryl d=cat 1 820027.

Non-final Office Action from U.S. Appl. No. 29/458,003, mailed Nov. 6, 2014.

* cited by examiner

ILLUMINATED DISPLAY BOARD HAVING AN ANGLED LIGHT SOURCE

FIELD

The field relates generally to display boards and, more specifically, to illuminated display boards used to illuminate printed or hand-written messages.

BACKGROUND

Bulletin boards and display boards are commonly used to convey messages to patrons of stores, restaurants and the like to call attention to items on sale or daily specials. Such messages are typically written on blackboards or other erasable or disposable mediums because the messages are often transient in nature and tend to be in effect for relatively short periods of time before new messages replace them.

Illuminated signs are also frequently used to advertise or convey messages to customers because of their visually appealing appearance. However, such illuminated signs are incompatible for use as bulletin or display boards because conventional illuminated signs are not designed to be changed.

At least some display boards use gas discharge lamps to provide edge-lighting for the display board. Gas-discharge lamps, like fluorescent and neon lamps, are used because they provide a uniformly distributed and brightly colored light. However, gas-discharge lamps tend to consume large amounts of energy, generate heat, and have relatively short lives, among other things. Further, gas discharge tubes tend to provide insufficient illumination of printed and written messages depicted by the display board.

Some display boards use other sources of light, such as light emitting diodes (LEDs), to provide edge lighting effects around the board. However, such display boards are not designed to provide maximum illumination of printed or hand-written messages depicted by the board.

Accordingly, a continuing need exists for a cost-efficient illuminated display board having a visually appealing appearance.

BRIEF SUMMARY

In one aspect, an illuminated display board generally comprises a frame having a lighting channel defined therein, a light-transmissive panel coupled to the frame, and a light source positioned within the lighting channel and adjacent the light-transmissive panel, wherein the light source is oriented at an angle of between about 25 degrees and about 50 degrees with respect to the light-transmissive panel.

In another aspect, an illuminated display board generally comprises a frame, a light-transmissive panel, and a light source. The light-transmissive panel includes opposing first and second surfaces and peripheral edges extending between the first and second surfaces along a perimeter of the light-transmissive panel. The light source is positioned within the frame and adjacent to at least one peripheral edge of the light-transmissive panel. The light source is oriented at an angle of between about 25 degrees and about 50 degrees with respect to the light-transmissive panel.

In yet another aspect, an illuminated display board generally comprises a frame, a light-transmissive panel coupled to the frame, a light source positioned within the frame and adjacent to the light-transmissive panel, and a stand including at least one stand member having a slot defined therein and a protrusion extending from the slot. The protrusion is configured to engage a lip on the frame.

In yet another aspect, an illuminated display panel generally comprises a frame, a light-transmissive panel coupled to the frame, and a light source positioned within the frame and adjacent to the light-transmissive panel. The frame includes retractable hangers coupled to the frame. The hangers are positioned along a perimeter of the frame and moveable between a first retracted position and a second extended position.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols used in the various drawings indicate like elements.

Although specific features of various embodiments may be shown in some drawings and not in others, this is for convenience only. Any feature of any drawing may be referenced and/or claimed in combination with any feature of any other drawing.

DETAILED DESCRIPTION

Illuminated display boards are described herein which provide an enhanced visual appearance compared to conventional display boards.

Figure 1:
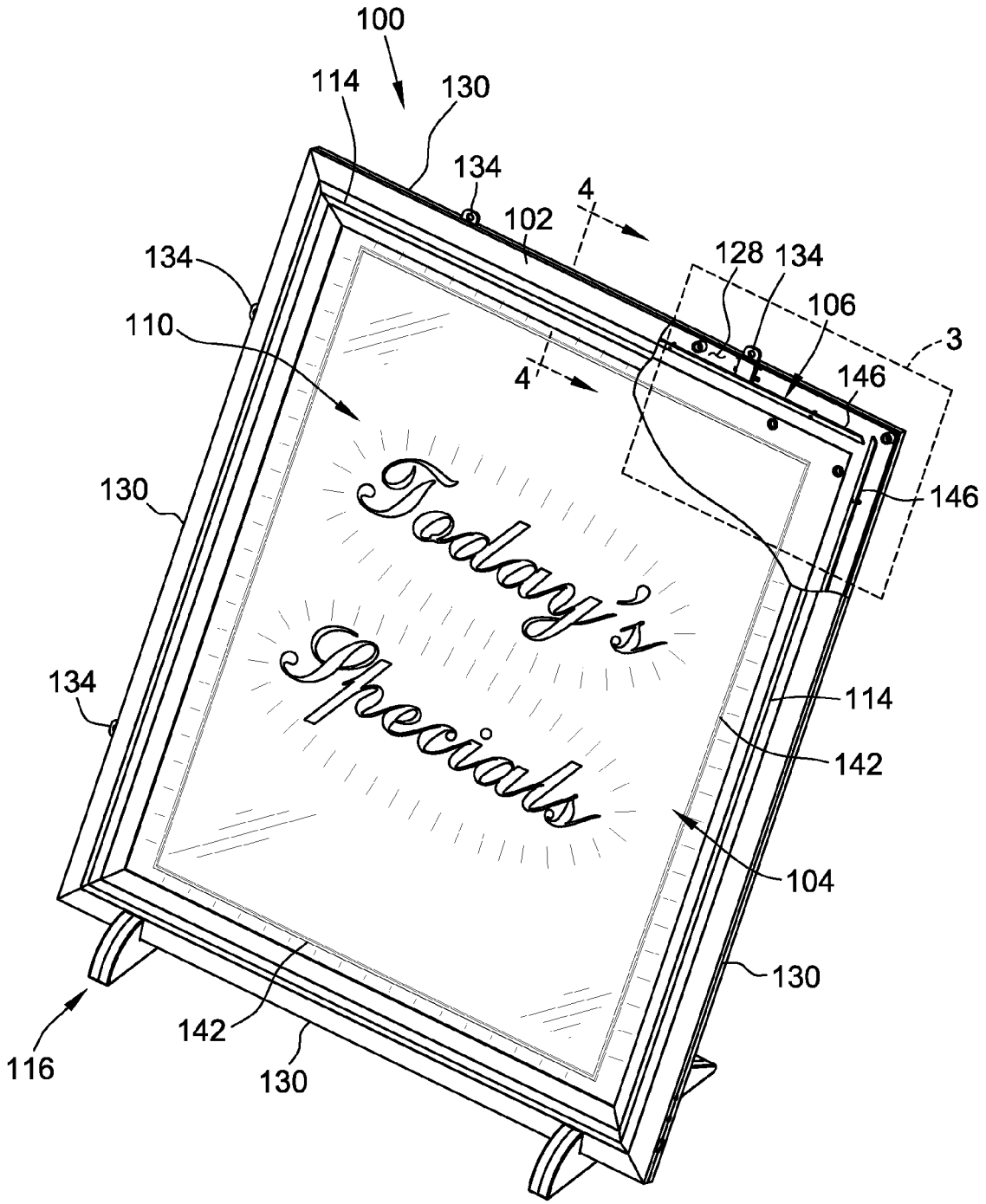
FIG. 1 is a perspective of one suitable embodiment of an illuminated display board with a portion broken away to show underlying features.
Figure 2:
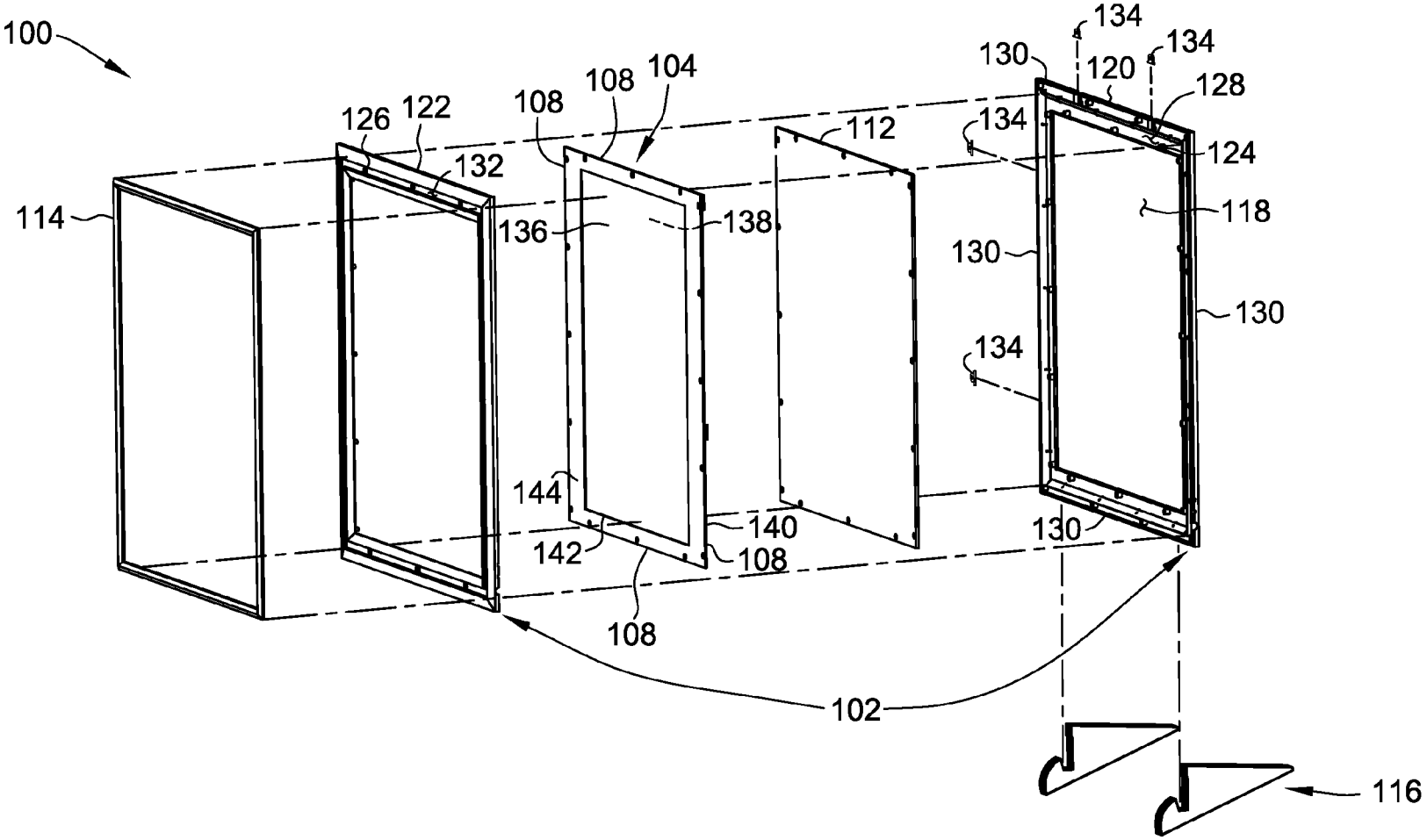
FIG. 2 is an exploded view of the illuminated display board of FIG. 1.

Referring to FIGS. 1 and 2, one suitable embodiment of an illuminated display board is indicated generally at 100. FIG. 1 is a perspective of the illuminated display board 100, and FIG. 2 is an exploded view of the illuminated display board 100. As shown in FIGS. 1 and 2, the illuminated display board 100 includes a frame 102, a light-transmissive panel 104, and a light source 106. A portion of the frame 102 is broken away in FIG. 1 for illustration. The frame 102, the light-transmissive panel 104, and the light source 106 are assembled such that the light source 106 illuminates the light-transmissive panel 104 along a peripheral edge 108 thereof, thereby illuminating messages, indicia, representations, or other graphic elements (collectively referred to as "a message" or "messages", indicated generally at 110 in FIG. 1) printed or written on the light-transmissive panel 104 (e.g., with fluorescent ink). In the embodiment illustrated in FIGS. 1 and 2, the illuminated display board 100 also includes a light reflecting panel 112, a cover 114, and a stand 116.

As shown in FIG. 2, the frame 102 defines a central opening 118 within which the light-transmissive panel 104 is positioned when the illuminated display board 100 is assembled. In the illustrated embodiment, the central opening 118 has a generally rectangular shape, although the central opening 118 may have any suitable shape that enables the illuminated display board 100 to function as described herein, such as a circle, an ellipse, a square, or other polygonal shape.

In the illustrated embodiment, the frame 102 is constructed from two frame members 120 and 122, which may be coupled together using a variety of means, including, for example, screws, adhesive, interference fit. In one suitable embodiment, the first frame member 120 includes threaded through-holes 124 and, and the second frame member 122 includes through holes 126 for receiving a threaded fastener. The frame 102 and the frame members 120 and 122 may be formed from a variety of materials, including moldable plastics, such as acrylonitrile butadiene styrene (ABS) and acrylic. In the illustrated embodiment, for example, the frame 102, including the frame members 120 and 122, is formed from opaque injection molded plastic.

The frame 102 includes a lighting channel 128 defined within the interior of the frame 102. The light source 106 is positioned within the lighting channel 128 when illuminated display board 100 is assembled. The lighting channel 128 extends between peripheral edges 108 of the light-transmissive panel 104 and exterior walls 130 of the frame 102. In the illustrated embodiment, lighting channel 128 is a single, continuous channel extending around the central opening 118. In alternative embodiments the lighting channel 128 may include multiple and/or separated lighting channels arranged around the central opening 118, each configured to receive a light source.

Figure 3:
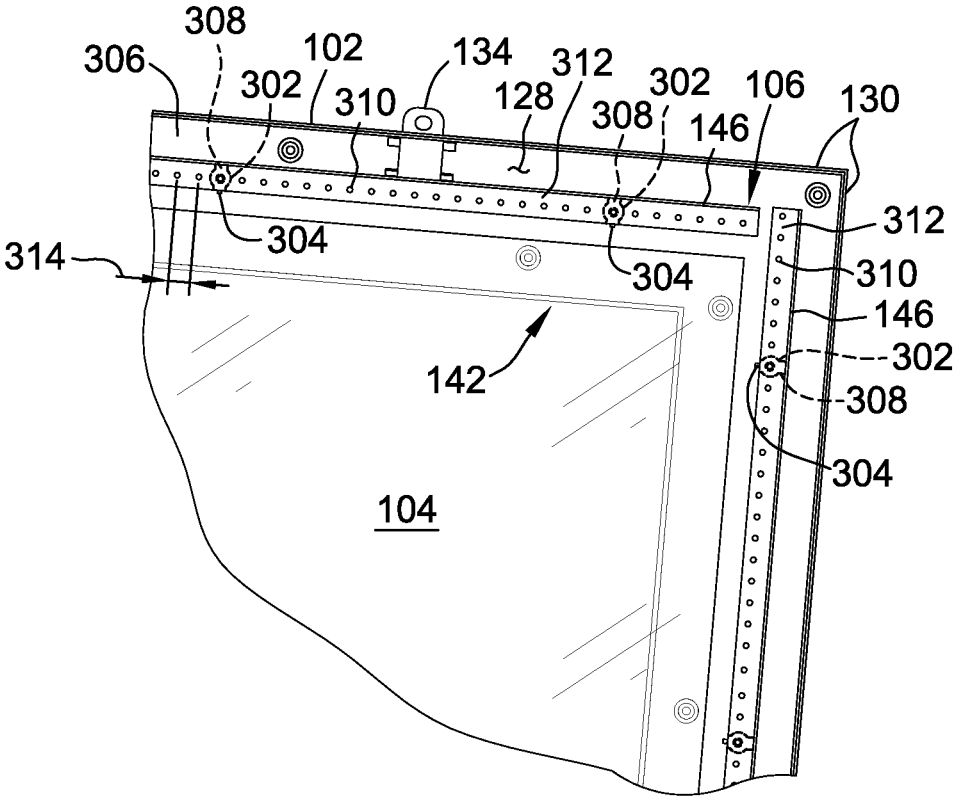
FIG. 3 is an enlarged partial rear view of the illuminated display board of FIG. 1.
Figure 4:
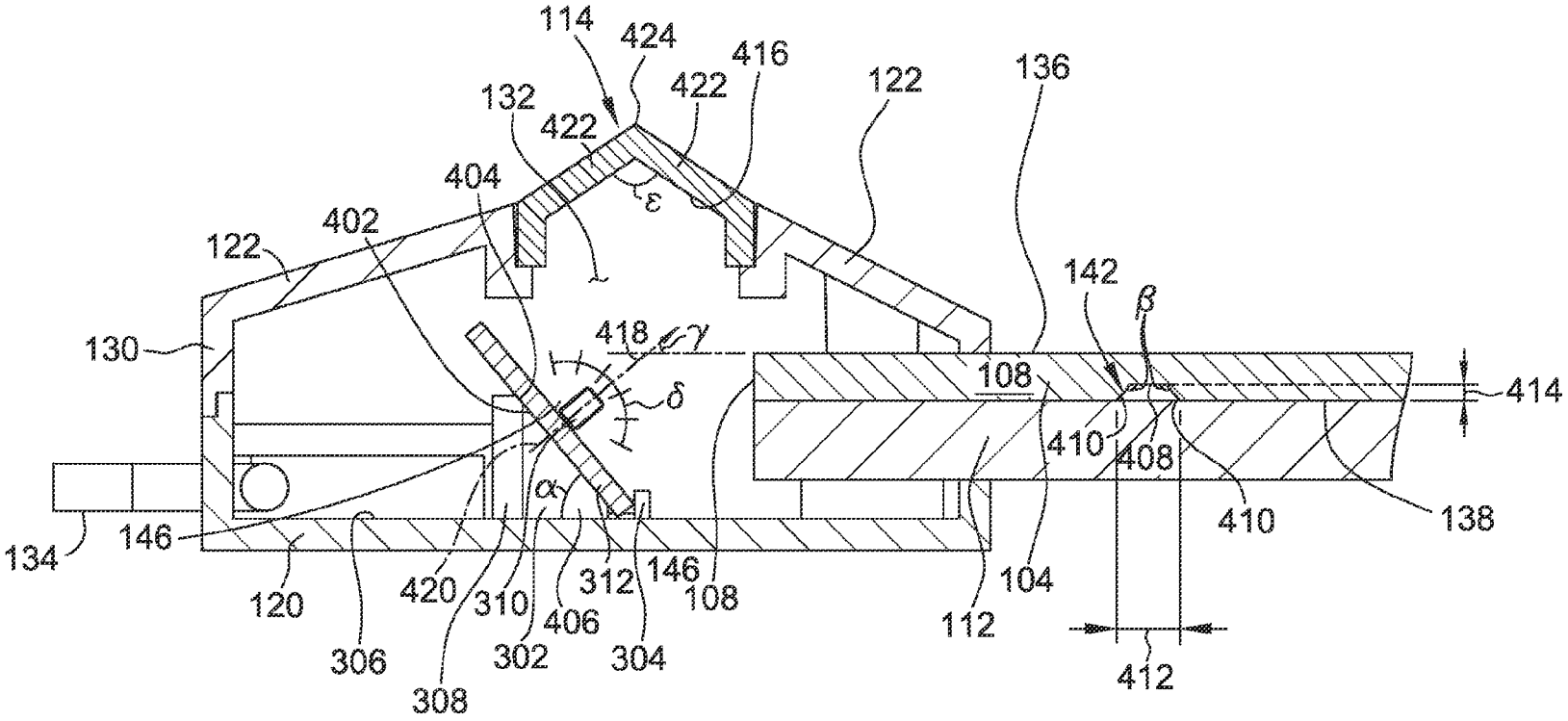
FIG. 4 is a partial cross-sectional view of the illuminated display board of FIG. 1 taken along line 4-4.

Referring to FIGS. 3-4, the lighting channel 128 includes a plurality of alignment members 302, 304 configured to support and align the light source 106 within the lighting channel 128. In the illustrated embodiment, alignment members 302, 304 are configured to orient the light source 106 at an angle with respect to the light-transmissive panel 104.

More specifically, in the illustrated embodiment, the lighting channel 128 includes first alignment members 302 and second alignment members 304 extending from an interior surface 306 of the frame 102. Each first alignment member 302 has a generally tubular configuration with a first angled support surface 402 (shown in FIG. 4). The first angled support surface 402 forms an angle $\alpha$ with the interior surface 306 of the frame 102 between about 35 degrees and about 70 degrees, more specifically between about 45 degrees and 60 degrees, and, even more specifically, the first angled support surface 402 forms an angle $\alpha$ with the interior surface 306 of the frame 102 of about 53 degrees. Each first alignment member 302 also includes a support leg 308 having a generally rectangular configuration and a second angled support surface 404 (shown in FIG. 4) adjoining the first angled support surface 402. Each second alignment member 304 has a generally rectangular configuration, and acts as a stop to prevent the light source 106 from sliding off of the first alignment member 302, although the second alignment member 304 may have any suitable shape that enables the alignment members 302, 304 to function as described herein. As shown in FIG. 4, each first alignment member 302 extends from the interior surface 306 of the frame 102 further than the second alignment member 304 corresponding to the first alignment member 302. Accordingly, each first alignment member 302 has a height greater than the height of the second alignment member 304 corresponding to the first alignment member 302. When assembled, alignment members 302, 304 support the light source 106 at least three points. Specifically, the light source 106 is supported by at least one of the first and second angled support surfaces 402, 404, the interior surface 306 of the frame 102, and the second alignment member 304. In the illustrated embodiment, the first and second alignment members 302, 304 are spaced apart from one another by a gap 406. In alternative embodiments, the first and second alignment members 302, 304 may be connected forming a single alignment member with a slot partially or completely defined by the first angled support surface 402 of the first alignment member 302 and the second alignment member 304.

In the illustrated embodiment, the frame 102 includes a peripheral opening 132 (shown in FIGS. 2-4) extending around the central opening 118, and substantially aligned with the lighting channel 128 and the light source 106. Thus, light emitted from the light source 106 disposed in the lighting channel 128 emanates out of the frame 102 through the peripheral opening 132. As shown in FIGS. 2 and 4, the peripheral opening 132 is configured to receive a cover 114 (described in more detail below), which provides an illuminating effect around the frame 102, and accentuates the illuminated messages 110 depicted by the illuminated display board 100.

Figure 5:
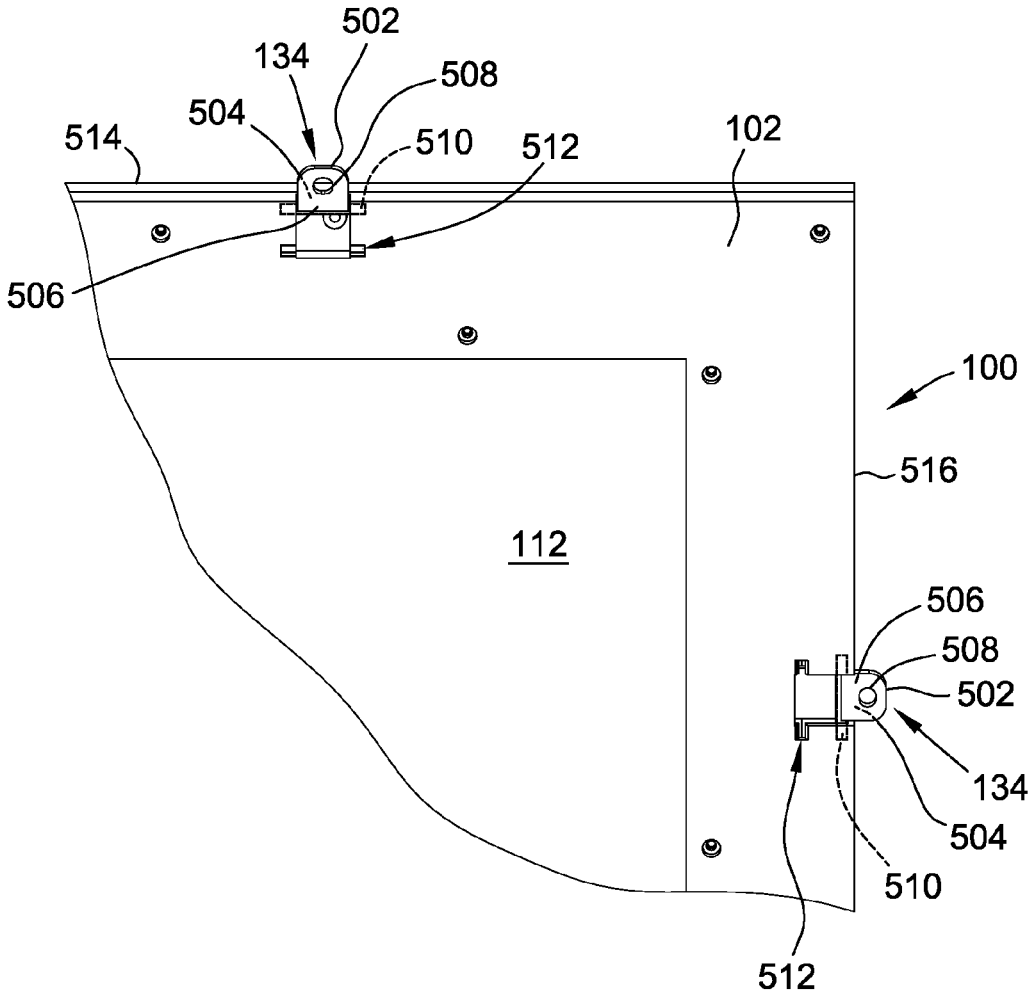
FIG. 5 is an enlarged partial view of the illuminated display board of FIG. 1.

In the illustrated embodiment, the frame 102 also includes a plurality of retractable hangers 134 for hanging or mounting illuminated display board 100 on a wall or other rigid structure (not shown). FIG. 5 is an enlarged rear view of illuminated display board 100. As shown in FIG. 5, retractable hangers 134 include an outer surface 502, at least a portion of which is substantially parallel to an exterior wall 130 of the frame 102, and opposing front and rear surfaces 504, 506. Each retractable hanger 134 also includes a circular opening 508 extending between the front and rear surfaces 504, 506. The opening 508 is configured to receive a fastener (not shown) to secure the frame 102 to a wall or other rigid structure. In alternative embodiments, the opening 508 may have any suitable shape that enables the illuminated display board 100 to function as described herein. In further alternative embodiments, one or more retractable hanger 134 may have a slot as an alternative to or in addition to the opening 508, similarly configured to receive a fastener (not shown) to secure the frame 102 to a wall or other rigid structure.

In the illustrated embodiment, retractable hangers 134 are slidably coupled to the frame 102 along an exterior wall 130 of the frame 102 such that the retractable hangers 134 can extend out of the frame 102 to a first position when in use, and retract into the frame 102 to a second position when not in use (e.g., when the stand 116 is used to support illuminated display board 100, described in more detail below). In one suitable embodiment, the retractable hangers 134 are coupled to the frame 102 by a tongue 510 and groove 512 type connection, although in alternative embodiments, the retractable hangers 134 may be coupled to the frame 102 in any suitable manner that enables the retractable hangers 134 to retract within the frame 102, such as hingedly coupled or rotatably coupled.

When the retractable hangers 134 are in the first position (shown along a top edge 514 of the frame 102 in FIG. 5), the retractable hangers 134 are completely within frame 102. Thus, the outer, front, and rear surfaces 502, 504, 506 of the retractable hanger 134 are completely within the frame 102 when the retractable hanger 132 is in the first position. In alternative embodiments, one or more of the outer, front, and rear surfaces 502, 504, 506 may be substantially flush with one or more surfaces of the frame 102 when the retractable hanger 134 is in the first position. When the retractable hangers are in the second position (shown along a side edge 516 of the frame 102 in FIG. 5), the retractable hangers 134 extend out of the frame 102 a sufficient distance such that at least a portion of the opening 508 is positioned outside of the frame 102. In the illustrated embodiment, the opening 508 is positioned completely outside of the frame 102 when the retractable hangers 134 are in the second position, although in alternative embodiments, such as embodiments having elongate openings, only a portion of the opening 508 may be positioned outside of the frame 102 when the retractable hangers 134 are positioned in the second position.

In the illustrated embodiment, retractable hangers 134 are positioned on adjacent sides of the frame 102 such that the frame 102 can be hung in two substantially perpendicular orientations, although in alternative embodiments, the retractable hangers 134 may be positioned along any side and any number of sides of the frame 102 that enables the illuminated display board 100 to function as described herein.

Referring again to FIGS. 1 and 2, the light-transmissive panel 104 is fabricated from generally transparent material (s), and is sufficiently rigid to enable printing or writing thereon (e.g., with fluorescent ink) of a message 110 to be depicted by illuminated display board 100. In the illustrated embodiment, for example, the light-transmissive panel 104 is fabricated from clear acrylic. In alternative embodiments, the light-transmissive panel 104 may be fabricated from any other suitably light-transmissive material that enables the illuminated display board 100 to function as described herein, such as glycol-modified polyethylene terephtalate (PETG), polycarbonate, other suitable polymers, glass.

Light-transmissive panel 104 includes a first, or front, surface 136 and an opposing second, or rear, surface 138 (also shown in FIG. 4). The first and second surfaces 136, 138 are substantially planar, parallel surfaces, although in alternative embodiments, the light-transmissive panel 104 may be tapered such that the first and second surfaces 136, 138 are not substantially parallel. In yet further alternative embodiments, one or more of the first and second surfaces 136, 138 may be other than a substantially planar surface, such as a curved or bowed surface.

The light-transmissive panel 104 also includes peripheral edges 108 defining the perimeter 140 of the light-transmissive panel 104. Peripheral edges 108 extend between first and second surfaces 136, 138 along perimeter 140 of light-transmissive panel 104. Light-transmissive panel 104 has a generally rectangular shape in the illustrated embodiment, and thus includes four peripheral edges 108. In alternative embodiments, light-transmissive panel 104 may have any other suitable shape that enables illuminated display board 100 to function as described herein, such as a circle, an ellipse, a square, or other polygonal shape. Accordingly, light-transmissive panel 104 may have any number of peripheral edges 108 that enables illuminated display board 100 to function as described herein. In the illustrated embodiment, peripheral edges 108 are oriented substantially perpendicular to first and second surfaces 136, 138, although in alternative embodiments, one or more peripheral edges 108 may be oriented at an angle other than substantially perpendicular to first surface 136 or second surface 138.

The light-transmissive panel 104 also includes a light-guiding channel 142 defined on the second surface 138, and visible through the first surface 136. In the illustrated embodiment, for example, the light-guiding channel 142 extends around the light-transmissive panel 104 in four segments, each of which extends in a direction substantially parallel to and spaced inwardly from a corresponding peripheral edge 108. In alternative embodiments, the light-guiding channel 142 may extend in a direction other than substantially parallel to at least one peripheral edge of the light-transmissive panel 104. The light-guiding channel 142 illustrated herein has a generally rectangular shape, although in alternative embodiments, the light-guiding channel 142 may have any suitable shape that enables the illuminated display board 100 to function as described herein, such as a line, an arc, a circle, an ellipse, a square, or other polygonal shape.

In operation, the light-guiding channel 142 is illuminated by the light source 106, and is configured to provide an added illumination effect on the light-transmissive panel 104. More specifically, referring to FIG. 4, the light-guiding channel 142 has a first facet 408 and angled facets 410 extending from the first facet 408 towards the second surface 138. In the illustrated embodiment, the first facet 408 is substantially parallel to the first surface 136, although in alternative embodiments, first facet 408 may be oriented in a direction other than substantially parallel to the first surface 136. Further, in the illustrated embodiment, each angled facet 410 is tapered at an angle β of between about 1 degree and about 180 degrees with respect to the first facet 408, more specifically between about 80 degrees and about 100 degrees with respect to the first facet 408, and, even more specifically, each angled facet 410 is tapered at an angle β of about 90 degrees with respect to the first facet 408. In alternative embodiments, angled facets 410 may be tapered at differing angles with respect to the first facet 408. In further alternative embodiments, angled facets 410 may be substantially parallel to one another.

Further, in the illustrated embodiment, the light-guiding channel 142 has a width 412 of between about 2 millimeters (0.08 inches) and about 6 millimeters (0.24 inches), more specifically between about 3 millimeters (0.11 inches) and about 5 millimeters (0.20 inches), and, even more specifically, the light-guiding channel 142 has a width 412 of about 4 millimeters. (0.16 inches). Also in the illustrated embodiment, the light-guiding channel 142 has a depth 414 of between about 10 millimeters (0.39 inches) and about 16 millimeters (0.63 inches), more specifically between about 12 millimeters (0.47 inches) and about 14 millimeters (0.55 inches), and, even more specifically, the light-guiding channel 142 has a depth 414 of about 13 millimeters (0.51 inches).

In operation, light emitted from the light source 106 is reflected and refracted by the facets 408, 410, producing a visually appealing illumination effect on the light-transmissive panel 104.

Referring again to FIGS. 1 and 2, the light-transmissive panel 104 is mounted to the frame 102 such that the light-guiding channel 142 is visible or viewable when viewed from the front (i.e., from the first surface 136). More specifically, the light-transmissive panel 104 is coupled to the frame 102 along an outer portion 144 of the light-transmissive panel 104 defined by the light-guiding channel 142. In the illustrated embodiment, the light-transmissive panel 104 is coupled to the frame 102 using threaded fasteners, although in alternative embodiments, any other suitable coupling means may be used that enables the illuminated display board 100 to function as described herein, such as adhesive, interference fit.

As shown in FIGS. 1-3, the light source 106 is positioned within the frame 102 and extends around the light-transmissive panel 104 when the illuminated display board 100 is assembled. More specifically, in the illustrated embodiment, the light source 106 includes four distinct linear light sources 146 (i.e., a generally straight, elongated light source), each aligned with a respective peripheral edge 108 of the light-transmissive panel 104. Each linear light source 146 is positioned adjacent to a respective peripheral edge 108 (specifically, adjacent to an external surface of the peripheral edge 108) of the light-transmissive panel 104.

In alternative embodiments, the light source 106 may be a single, continuous light source aligned with at least one peripheral edge 108 of the light-transmissive panel 104. In yet further alternative embodiments, the light source 106 may only extend partially around the light-transmissive panel 104, and be aligned with less than all peripheral edges 108 of the light-transmissive panel 104.

Referring to FIG. 3, in the illustrated embodiment, each linear light source 146 includes a plurality of point light sources 310 electrically connected to a generally rectangular printed circuit board (PCB) 312. In alternative embodiments, one or more linear light source 146 may have a single, continuous light source, such as a fluorescent or neon lamp. Further, in the illustrated embodiment, the point light sources 310 are light emitting diodes, although the point light sources 310 may be any suitable point light source that enables the illuminated display board 100 to function as described herein.

The point light sources 310 are linearly aligned along PCBs 312, and are spaced apart from one another by a distance 314, also known as "pitch". In the illustrated embodiment, the point light sources 310 are configured to appear as a generally continuous, uniform light source. More specifically, the distance 314 between adjacent point light sources 310 is between about 10 millimeters (0.39 inches) and about 15 millimeters (0.59 inches), more specifically between about 12 millimeters (0.47 inches) and about 14 millimeters (0.55 inches), and, even more specifically, the distance 314 between adjacent point light sources 310 is about 12 millimeters (0.47 inches).

Referring again to FIG. 4, in the illustrated embodiment, each linear light source 146 is oriented at an angle with respect to the light-transmissive panel 104 such that the linear light sources 146 illuminate the light-transmissive panel 104 along peripheral edges 108, and the cover 114 along an interior surface 416 of the cover 114. More specifically, linear light sources 146 are positioned within the frame 102 such that the primary direction of transmission 418 of each linear light source 146 forms an angle $\gamma$ of between about 25 degrees and about 50 degrees with respect to the first surface 136 of light-transmissive panel 104, more specifically between about 35 degrees and about 40 degrees, and, even more specifically, the primary direction of transmission 418 of each linear light source 146 forms an angle $\gamma$ of about 37 degrees with respect to the first surface 136 of the light-transmissive panel 104. In the illustrated embodiment, each point light source 310 has a beam angle $\delta$ of between about 105 degrees and about 135 degrees centered around the longitudinal axis 420 of the point light source 310. Accordingly, the primary direction of light transmission of each point light source 310 coincides with the longitudinal axis 420 of the respective point light source 310. In alternative embodiments, point light sources 310 may have any suitable beam angle that enables illuminated display board 100 to function as described herein.

Referring again to FIGS. 1 and 2, the light reflecting panel 112 is positioned in a face-to-face relationship with the light-transmissive panel 104. The light reflecting panel 112 is configured to keep light emanating from the light source 106 within light-transmissive panel 104 to provide maximum reflection and refraction within the light-transmissive panel 104. In the illustrated embodiment, the light reflecting panel 112 has a similar configuration to the light-transmissive panel 104, with the exception that the light reflecting panel 112 is fabricated from an opaque material, and light reflecting panel 112 does not have a light-guiding channel defined therein.

The cover 114 is removably coupled to the frame 102 along the peripheral opening 132. The cover 114 is shaped in substantially the same shape as the peripheral opening 132 (i.e., generally rectangular), although in alternative embodiments, the cover 114 may have a shape other than the shape of the peripheral opening 132. In operation, light emitted from the light source 106 impinges upon and illuminates the cover 114, which is one of translucent or transparent, thereby providing an illuminating effect around the frame 102, and accentuating illuminated messages 110 depicted by the illuminated display board 100.

The cover 114 may be fabricated from a variety of materials, including moldable plastics, such as acrylonitrile butadiene styrene (ABS) and acrylic. In the illustrated embodiment, the cover 114 is fabricated from translucent acrylic. The cover 114 may be coupled to the frame 102 using a variety of means, including, for example, screws, adhesive, interference fit. In the illustrated embodiment, the cover 114 is coupled to the frame 102 by an interference fit. The translucency or transparency of the cover 114 may vary in different embodiments, for example, by applying a frosted or textured finish to an interior surface 416 (i.e., the surface facing the light source 106) of the cover 114.

Referring to FIG. 4, the cover 114 includes two angled facets 422 joined together at an apex 424 centrally located along the cover 114. In alternative embodiments, the cover 114 may include any suitable number of facets and any suitable type of facet (e.g., forward facing or non-angled facets) that enables the illuminated display board 100 to function as described herein. In the illustrated embodiment, angled facets 422 form an angle $\epsilon$ with respect to one another. Specifically, in the illustrated embodiment, the angle $\epsilon$ formed by angled facets 422 is between about 1 degrees and about 125 degrees, more specifically between about 40 degrees and about 95 degrees, and, even more specifically, the angle $\epsilon$ formed by angled facets 422 is about 50 degrees.

Figure 6:
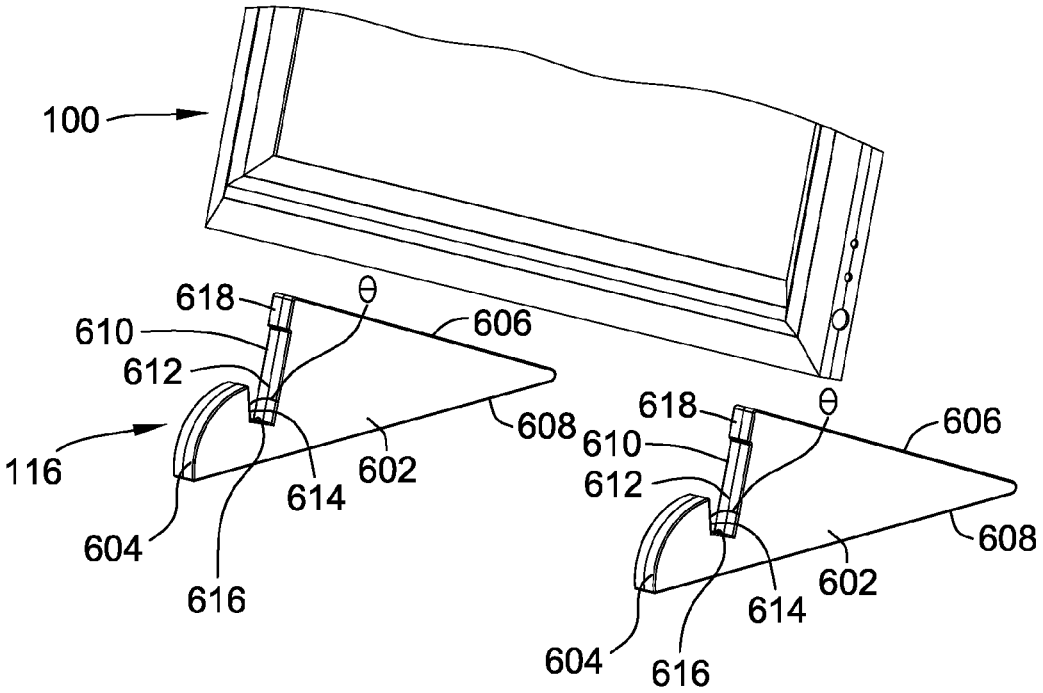
FIG. 6 is a perspective of a stand used to support the illuminated display board of FIG. 1.
Figure 7:
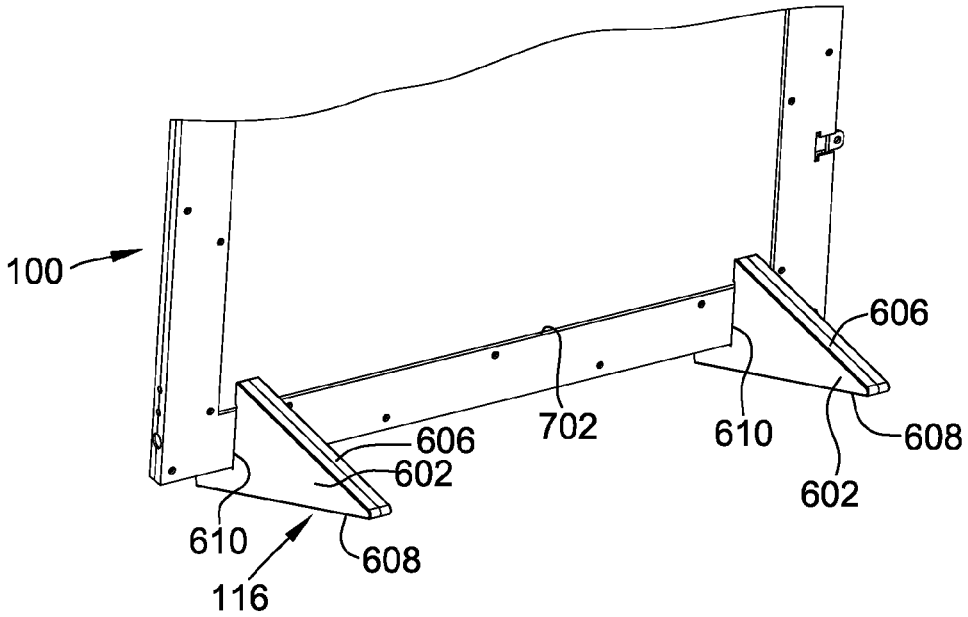
FIG. 7 is another perspective of the stand of FIG. 6.

Referring again to FIGS. 1 and 2, in the illustrated embodiment, the illuminated display board 100 includes a stand 116 for supporting the frame 102 in a generally upright position. FIGS. 6 and 7 are perspectives of the stand 116. As shown in FIGS. 6 and 7, the stand 116 includes two stand members 602 adapted to be selectively spaced-apart from each other. Each stand member 602 includes an arcuate front surface 604, a sloped or tapered upper surface 606, and a bottom surface 608 configured to rest on a ground or floor surface. Each of the stand members 602 also include a slot 610 defined therein for receiving the frame 102.

In the illustrated embodiment, the slot 610 in each stand member 602 is defined between the front surface 604 and the upper surface 606 of the stand member 602. The slot 610 includes first and second slot sidewalls 612, 614 disposed at an angle $\theta$ with respect to one another, and a lower slot surface 616 extending between the first and second slot sidewalls 612, 614. The front surface 604 of each stand member 602 extends from the bottom surface 608 to the second slot sidewall 614, and the sloped upper surface 606 extends from the bottom surface 608 to the first slot sidewall 612. In the illustrated embodiment, the first and second slot sidewalls 612, 614 are disposed at an angle θ of between about 45 degrees and about 180 degrees with respect to one another, more specifically between about 55 degrees and about 120 degrees with respect to one another, and, even more specifically, the first and second slot sidewalls 612, 614 are disposed at an angle θ of about 80 degrees with respect to one another. In alternative embodiments, the first and second slot sidewalls 612, 614 may be disposed at any suitable angle that enables the stand 116 to function as described herein, including, for example, 90 degrees. In the illustrated embodiment, the lower slot surface 616 is substantially perpendicular to the first slot sidewall 612, although in alternative embodiments, the lower slot surface 616 may be other than substantially perpendicular to the first slot sidewall 612.

A protrusion 618 extends into an upper portion of the slot 610. In the illustrated embodiment, the protrusion 618 extends from the first slot sidewall 612, although in alternative embodiments, the protrusion 618 may extend from any other surface of the stand member 602 that enables the stand 116 to function as described herein, such as the second slot sidewall 614. The protrusion 618 is configured to engage a lip 702 located on the frame 102 when the frame 102 is inserted into slots 610 and rotated to engage a surface of the stand member 602 defining the slot 610. In the illustrated embodiment, the lip 702 is located on a rear surface of the frame 102, although in alternative embodiments, the lip 702 may be located on any surface of the frame that enables the illuminated display board 100 to function as described herein, such as a front surface of the frame 102.

In the illustrated embodiment, the stand 116 includes two stand members 602, although in alternative embodiments, the stand 116 may include any suitable number of stand members 602 that enables the stand 116 to function as described herein. In yet further alternative embodiments, the stand 116 may include a single stand member (e.g., a single, elongated stand member having the above described features of the stand members 602).

The above described illuminated display boards provide a display board having an enhanced visual appearance capable of depicting illuminated messages that can be easily and efficiently altered. Specifically, the illuminated display boards described herein utilize linear light sources positioned along the peripheral edges of a light-transmissive panel to enhance the visual appearance of the display board. Further, in the illuminated display boards described herein, the light sources are angled with respect to the light-transmissive panel to provide optimal light reflection and refraction within the light-transmissive panel. Yet further, the illuminated display boards described herein utilize a light-guiding channel defined within the light-transmissive channel to provide an additional illumination effect and accentuate messages depicted by the illuminated display board.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. An illuminated display board comprising:

a frame having a peripheral opening and a lighting channel defined within the frame and aligned with the peripheral opening;

a light-transmissive panel coupled to the frame;

a light source positioned within the lighting channel and adjacent the light-transmissive panel, wherein the light source is oriented at an angle of between about 25 degrees and about 50 degrees with respect to the light-transmissive panel and is orientated at another angle of between about 30 degrees and about 70 degrees with respect to the lighting channel; and a light-guiding channel defined within the light-transmissive panel, the light-guiding channel comprises a first facet and a second facet, the first facet is planar shape and is substantially parallel to the light-transmissive panel and the second facet is coupled to the first facet and extends angularly from the first facet, wherein the light-guiding channel is shaped to reflect and refract light emitted from the light source.

2. The illuminated display board in accordance with claim 1, wherein the light source comprises a plurality of light sources aligned linearly along a peripheral edge of the light-transmissive panel.

3. The illuminated display board in accordance with claim 2, wherein each light source of the plurality of light sources is oriented at an angle of between about 25 degrees and about 50 degrees with respect to the light-transmissive panel.

4. The illuminated display board in accordance with claim 1, wherein the light-transmissive panel includes peripheral edges extending around a perimeter of the light-transmissive panel, and the light source comprises a plurality of linear light sources, wherein at least one linear light source is positioned adjacent to each peripheral edge of the light-transmissive panel.

5. The illuminated display board in accordance with claim 4, wherein each linear light source is oriented at an angle of between about 25 degrees and about 50 degrees with respect to the light-transmissive panel.

6. The illuminated display board in accordance with claim 1, wherein the lighting channel comprises a first alignment member and a second alignment member which are coupled to the light source and are configured to orientate the light source at the angle of between about 25 degrees and about 50 degrees with respect to the light-transmissive panel.

7. The illuminated display board in accordance with claim 6, wherein the second alignment member comprises a generally rectangular configuration and is configured to stop the light source from sliding off of the first alignment member.

8. The illuminated display board in accordance with claim 6, wherein the first alignment member has a height greater than the height of the second alignment member.

9. The illuminated display board in accordance with claim 1, wherein the second facet extends angularly from the first facet and towards the light-transmissive panel.

10. The illuminated display board in accordance with claim 9, wherein the second facet comprises a pair of angled facets which is tapered at an angle of between about 1 degree and about 180 degrees with respect to the first facet.

11. The illuminated display board in accordance with claim 9, wherein the first facet and the second facet are configured to reflect and refract light emitted from the light source.

12. The illuminated display board in accordance with claim 1, wherein the light-transmissive panel comprises opposing first and second surfaces; and peripheral edges extending between the first and second surfaces along a perimeter of the light-transmissive panel, and wherein the light-guiding channel extends in a direction substantially parallel to at least one peripheral edge of the light-transmissive panel, wherein the light source is positioned adjacent the at least one peripheral edge of the light-transmissive panel.

13. The illuminated display board in accordance with claim 1, wherein the light source has a primary transmission direction, the light source being oriented such that the primary transmission direction of the light source forms an angle between about 25 degrees and about 50 degrees with respect to the light-transmissive panel.

14. The illuminated display board in accordance with claim 1, wherein the light source includes a plurality of light emitting diodes.

15. The illuminated display board in accordance with claim 1, wherein the light source is oriented at an angle of between about 35 degrees and about 40 degrees with respect to the light-transmissive panel.

16. The illuminated display board in accordance with claim 1 further comprising a cover removably coupled to the frame along a peripheral opening within the frame, the cover comprising at least one of a translucent material and a transparent material.

17. The illuminated display board in accordance with claim 1 wherein the light-transmissive panel comprises acrylic or glass.

18. The illuminated display board in accordance with claim 1, further comprising a cover removably coupled to the frame along a peripheral opening within the frame, the cover comprising a pair of angled facets joined together at an apex centrally located along the cover.

19. The illuminated display board in accordance with claim 1, further comprising a cover removably coupled to the frame along a peripheral opening within the frame, the cover comprising a pair of angled facets joined together at an angle of between about 1 degrees and about 125 degrees.

20. The illuminated display board in accordance with claim 1, wherein the light source is configured to emit a beam of light at an angle of between about 105 degrees and about 135 degrees centered around a longitudinal axis of the light source.

21. The illuminated display board in accordance with claim 1, further comprising a light reflecting panel coupled to the frame and the light-transmissive panel and exposed to the light-guiding channel.

22. An illuminated display board comprising:

a frame having a peripheral opening;

a light-transmissive panel including opposing first and second surfaces, and peripheral edges extending between the first and second surfaces along a perimeter of the light-transmissive panel;

a light source positioned within the frame and adjacent to at least one peripheral edge of the light-transmissive panel, wherein the light source is oriented at an angle of between about 25 degrees and about 50 degrees with respect to the light-transmissive panel and is orientated at another angle of between about 30 degrees and about 70 degrees with respect to the frame; and a translucent cover removably coupled to the frame along the peripheral opening, the translucent cover comprising a pair of angled facets joined together at an angle of between about 1 degree and about 125 degrees and wherein the light source is oriented at another angle of between about 30 degrees and about 70 degrees with respect to the translucent cover.

23. The illuminated display board in accordance with claim 22, wherein the light source comprises a plurality of linear light sources, wherein at least one linear light source is positioned adjacent to each peripheral edge of the light-transmissive panel.

24. The illuminated display board in accordance with claim 23, wherein each linear light source is oriented at an angle of between about 25 degrees and about 50 degrees with respect to the light-transmissive panel.

25. The illuminated display board in accordance with claim 23, wherein each linear light source is oriented at an angle of between about 25 degrees and about 50 degrees with respect to at least one of the first surface and the second surface of the light-transmissive panel.

26. The illuminated display board in accordance with claim 22, wherein the light source is oriented at an angle of between about 25 degrees and about 50 degrees with respect to at least one of the first surface and the second surface of the light-transmissive panel.

27. The illuminated display board in accordance with claim 22, wherein the light source is oriented at an angle of between about 35 degrees and about 40 degrees with respect to the light-transmissive panel.

28. The illuminated display board in accordance with claim 22, wherein the light-transmissive panel further includes a light-guiding channel defined within the second surface, the light-guiding channel extending in a direction substantially parallel to at least one peripheral edge of the light-transmissive panel.

29. An illuminated display board comprising:

a frame;

a light-transmissive panel coupled to the frame;

a light source positioned within the frame and adjacent to the light-transmissive panel;

a light-guiding channel defined within the light-transmissive panel, wherein the light-guiding channel comprises a first facet and a second facet, the first facet is planar shape and is substantially parallel to the light-transmissive panel and the second facet is coupled to the first facet and extends angularly from the first facet and towards the light-transmissive panel, the second facet comprises a pair of angled facets which is tapered at an angle of between about 1 degree and about 180 degrees with respect to the first facet, wherein the light-guiding channel is shaped to reflect and refract light emitted from the light source;

a translucent cover coupled to the frame and around the light-transmissive panel and configured to transmit light emitted from the light source; and a stand comprising at least one stand member having a slot defined therein and a protrusion extending from the slot, the protrusion configured to engage a lip on the frame.

30. An illuminated display board comprising:

a frame comprising retractable hangers coupled to the frame, said hangers positioned along a perimeter of the frame and moveable between a first retracted position within the frame and a second extended position beyond the frame;

a light-transmissive panel coupled to the frame and including opposing first and second surfaces, and peripheral edges extending between the first and second surfaces along a perimeter of the light-transmissive panel;

a light source positioned within the frame and adjacent to at least one peripheral edge of the light-transmissive panel, wherein the light source is configured to emit a beam of light centered around a longitudinal axis of the light source;

a light-guiding channel defined within the light-transmissive panel, wherein the light-guiding channel is shaped to reflect and refract light emitted from the light source; and a translucent cover coupled adjacent to the frame perimeter and spaced from the light-transmissive panel, wherein the translucent cover is shaped to transmit light emitted from the light source.

31. An illuminated display board comprising:

a frame having a peripheral opening and a lighting channel defined within the frame and aligned with the peripheral opening;

a light-transmissive panel including opposing first and second surfaces, and peripheral edges extending between the first and second surfaces along a perimeter of the light-transmissive panel;

a light source positioned within the lighting channel and adjacent the light-transmissive panel, wherein the light source is oriented at an angle of between about 25 degrees and about 50 degrees with respect to the light-transmissive panel and is orientated at another angle of between about 30 degrees and about 70 degrees with respect to the lighting channel;

a light-guiding channel defined within the light-transmissive panel and extended in a direction substantially parallel to at least one peripheral edge of the light-transmissive panel, the light-guiding channel comprises a first facet and a second facet, the first facet is planar shape and is substantially parallel to the light-transmissive panel and the second facet is coupled to the first facet and extends angularly from the first facet, wherein the light-guiding channel is shaped to reflect and refract light emitted from the light source; and a cover removably coupled to the frame along the peripheral opening, the cover comprising a pair of angled facets joined together at an angle of between about 1 degree and about 125 degrees and wherein the light source is oriented at another angle of between about 30 degrees and about 70 degrees with respect to the cover.

* * * * *